US006109309A

United States Patent [19]

Dornier et al.

[11] Patent Number: 6,109,309

[45] Date of Patent: Aug. 29, 2000

[54] COMPRESSED AIR DISTRIBUTOR BLOCK ARRANGEMENT IN AN AIR JET LOOM WEFT INSERTION DEVICE

[75] Inventors: Peter D. Dornier, Nonnenhorn; Valentin Krumm, Hergensweiler, both of Germany

[73] Assignee: Lindauer Dornier Gesellschaft mbH, Lindau, Germany

[21] Appl. No.: 09/286,300

[22] Filed: Apr. 6, 1999

[30] Foreign Application Priority Data

Apr. 9, 1998 [DE] Germany ..... 298 06 552 U

[51] Int. Cl.[7] ..... D03D 47/30

[52] U.S. Cl. ..... 139/435.3; 139/435.4

[58] Field of Search ..... 139/435.4, 435.3, 139/453, 435.1

[56] References Cited

U.S. PATENT DOCUMENTS

| | | | |
|---|---|---|---|
| 4,850,398 | 7/1989 | Van Bogaert | 139/435.1 |
| 5,417,250 | 5/1995 | Markey | 139/435.3 |
| 5,540,261 | 7/1996 | McGinley | 139/435.3 |

FOREIGN PATENT DOCUMENTS

| | | |
|---|---|---|
| 0203256A1 | 12/1986 | European Pat. Off. . |
| 0619391A1 | 10/1994 | Germany . |
| 82/03877 | 11/1982 | WIPO . |
| WO97/29231 | 8/1997 | WIPO . |

OTHER PUBLICATIONS

Patent Abstracts of Japan, 02041440, Feb. 9, 1990, Device for Picking in Jet Loom.

Patent Abstracts of Japan, 06220745, Aug. 9, 1994, Device for Restoring Weft in Jet Loom.

European Patent Office Search Report, Jul. 14, 1999.

*Primary Examiner*—Andy Falik

*Attorney, Agent, or Firm*—Evenson, McKeown, Edwards & Lenahan, P.L.L.C.

[57] ABSTRACT

A weft thread insertion device for an air jet loom includes a nozzle block mounted on a sley to be movable together therewith. The movable block has a plurality of individual nozzles. Devices supply compressed air to the nozzle block by way of one or more stationary distributor blocks. At least one outlet is associated with the distributor block. Compressed air is supplied through respective flexible pressure lines from the respective outlets to respective inlets of the individual nozzles of the nozzle block. In order to supply air using short pressure lines that do not intersect, the invention provides that the distributor block or blocks so arranged that they at least partially surround nozzle block regardless of the position of the reed.

25 Claims, 4 Drawing Sheets

COMPRESSED AIR DISTRIBUTOR BLOCK ARRANGEMENT IN AN AIR JET LOOM WEFT INSERTION DEVICE

BACKGROUND AND SUMMARY OF THE INVENTION

This application claims the priority of German application 5 298 06 552.2, filed in Germany on Apr. 9, 1998, the disclosure of which is expressly incorporated by reference herein.

The invention relates to a weft thread insertion device for an air jet loom comprising at least one main nozzle block mounted on a sley and movable together with the latter, said main nozzle block having at least one individual nozzle, devices for supplying compressed air to the main nozzle block with which one or more stationary distributor blocks are associated, said distributor blocks each having at least one outlet, from which outlet compressed air is supplied through a flexible pressure line to the inlet of a respective individual nozzle of the main nozzle block.

In known weft thread insertion devices for air jet looms, the main nozzle block mounted on the sley is supplied with compressed air by flexible pressure lines. The air is supplied to the individual nozzles through distributing arrangements permanently mounted on the machine frame and connected by the abovementioned pressure lines with the individual nozzles. Since the main nozzle block is mounted on the sley and consequently performs oscillating pivoting movements together with the sley, the pressure lines between the distributor block and the main nozzle block must be of a certain length so that problem-free air supply to the main nozzle block is guaranteed in every position of the sley. For example, kinking of the flexible pressure lines can temporarily change their cross section with each movement of the sley, and a certain amount of waste air is associated with each change in cross section. In addition, it was previously difficult, because of the relatively long pressure lines and the limited space available, to run the pressure lines without intersection and simultaneously to keep them as short as possible. However, with a certain length of each pressure line there is the problem that the pressure buildup upstream of the main nozzle block is delayed or a pressure loss occurs that must be corrected by increasing the diameter of the pressure lines or by control measures.

A system with improved air supply to the main nozzle block is described in European Patent Document EP 619 391 B1. In this case, the pressure lines between the distributor block and the main nozzle block are kept short, while the distributor block is located approximately centrally between the end positions of the movement of the sley, with the main nozzle block performing the pivoting movements together with the sley. As a result, the mechanical stress on the lines and the pressure loss can both be reduced.

In a main nozzle block with a pre-nozzle block, however, it is still difficult to run the plurality of individual pressure lines for the shortest distance without intersections and without kinks between the distributor block and the nozzle blocks in question.

Hence, a goal of the invention is to improve the weft thread insertion device for air jet looms of the species recited at the outset.

This goal is achieved by providing an arrangement wherein the one or more stationary distributor blocks at least partially surround the main nozzle block independently of the position of the sley.

The invention is based on the fact that the distributor block or blocks are so arranged that they at least partially surround the main nozzle block regardless of the position of the sley.

Because the inlets for the individual nozzles of the main nozzle block are advantageously distributed over the circumference of the main nozzle block and the outlets of the distributor block may be located according to the invention directly opposite the associated inlet, the advantage is obtained that the length of the pressure lines between the outlet and the inlet can be reduced to a minimum. It is also possible to run the pressure lines without intersection in a simple fashion so that the individual lines do not rub against one another during weaving. Another advantage is that as a result of the arrangement of the distributor blocks according to the invention, all of the pressure lines have essentially the same length so that the delays in building up pressure upstream from the main nozzle block are the same.

In a first embodiment, a plurality of individual distributor blocks is provided, arranged approximately in the shape of an L or U around the main nozzle block. The individual distributor blocks can be arranged in a plane perpendicularly to the lengthwise axis of the sley or they can be staggered with respect to one another in space in the direction of the lengthwise axis of the sley. The staggered arrangement, for example when a so-called tandem arrangement of pre-nozzles and main nozzles is used, has the advantage that both nozzles can be supplied with compressed air through relatively short pressure lines.

According to another embodiment, the distributor block is made in the shape of an arc or the letter U, with the outlets being arranged at constant or variable intervals on the arc or the U of the distributor block.

In known fashion, a controllable valve is associated with each outlet on the distributor block, so that the air supplied to each individual nozzle can be regulated.

Other objects, advantages and novel features of the present invention will become apparent from the following detailed description of the invention when considered in conjunction with the accompanying drawings.

DETAILED DESCRIPTION OF THE DRAWINGS

Figure 1:
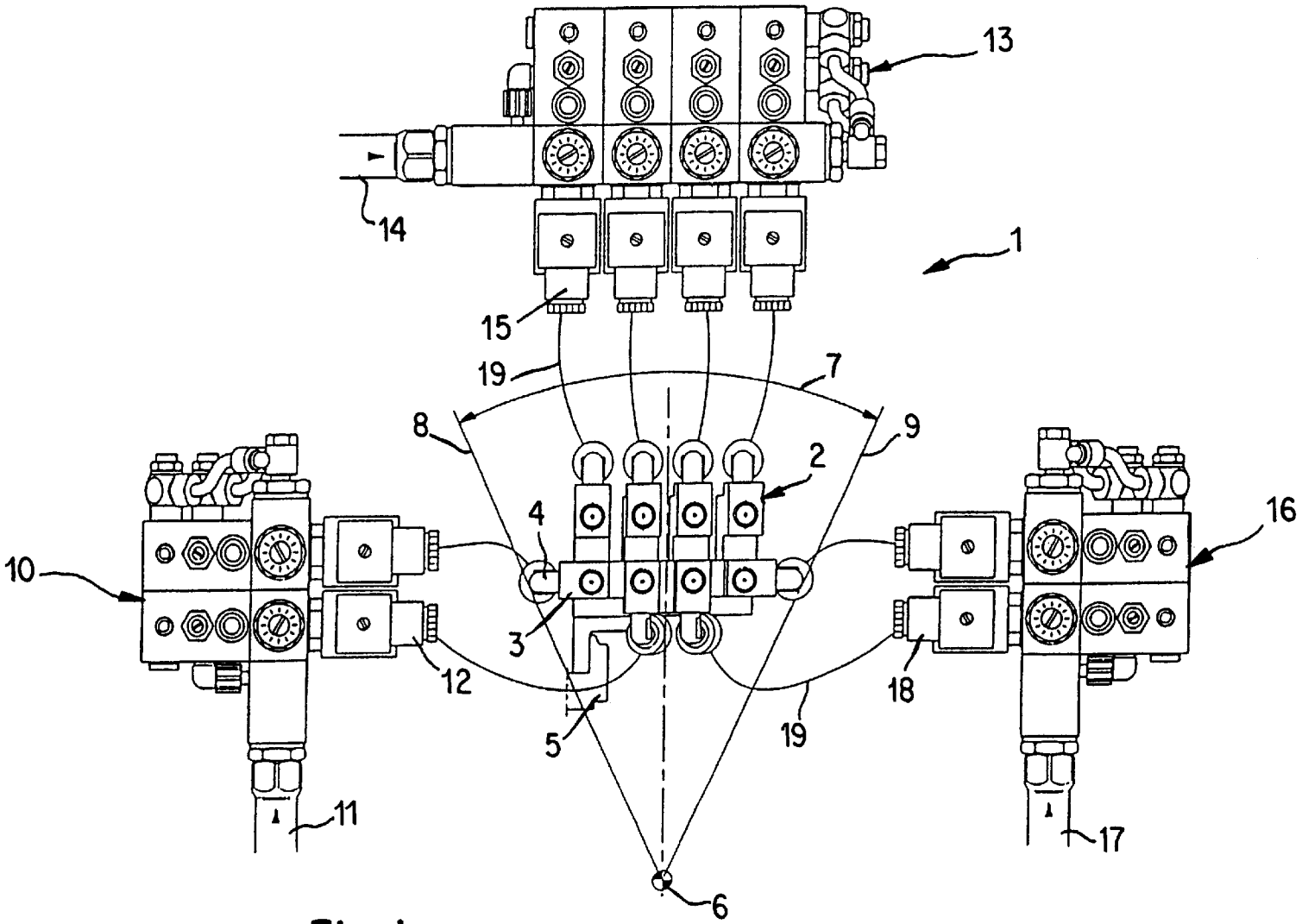
FIG. 1 is a front view of a weft thread insertion device constructed according to a first embodiment of the present invention.

FIG. 1 shows a main nozzle block 2 that has a plurality, a total of 8 in the embodiment shown of individual nozzles 3 arranged side by side in two rows of 4 nozzles each. An inlet 4 is associated with each individual nozzle 3, through which inlet the nozzle is a supplied with compressed air. In order to ensure accessibility to the inlets 4, the inlets are distributed in suitable fashion around the circumference of main nozzle block 2.

The main nozzle block 2 is permanently attached to sley 5 by connecting elements, not shown, said sley being indicated only schematically here. During the operation of the loom, the reed 5 moves back and forth around lengthwise axis 6, alternating between two end positions 8, 9, namely between the weft thread insertion position 8 and the weft thread beating-up position 9. The direction of motion is indicated by the double arrow 7. The main nozzle block 2 also moves back and forth between end positions 8, 9 together with sley 5.

The weft thread insertion device 1 also comprises a plurality of distributor blocks 10, 13 and 16 arranged outside the working area of sley 5 approximately in the shape of a U around the main nozzle block 2. The individual nozzles 3 are supplied with compressed air through these distributor blocks 10, 13, 16.

Each distributor block 10, 13, 16 has a main air supply 11,14, and 17 through which it is supplied with compressed air. The compressed air flows in the channel inside distributor block 10, 13, 16 and is distributed to a plurality of outlets 12, 15, and 18. Each outlet 12, 15, 18 is individually controllable via a valve, for example a solenoid valve. In the present example, the outlets 12, 15, 18 of distributor blocks 10, 13, 16 are arranged side by side in a row. However, arrangements with two rows are also contemplated.

The outlets 12, 15, 18 of distributor blocks 10, 13, 16 are each connected by a flexible pressure line 19 with an associated inlet 4 of the individual nozzles 3. Each inlet 4 of the individual nozzles 3 is supplied according to the invention by the distributor block whose outlet is located directly opposite the inlet of the nozzle, in other words the inlets 4 in the upper part of main nozzle block 2 are supplied from the upper distributor block 13 while for example the inlets 4 in the left part of main nozzle block 2 are supplied by the left distributor block 10. As a result, the length of the pressure lines 19 can be kept very short, with the determination of the tube lengths being governed by the end positions 8, 9 of sley 5 located remotely from the corresponding distributor block 10, 13, 16.

Figure 4:
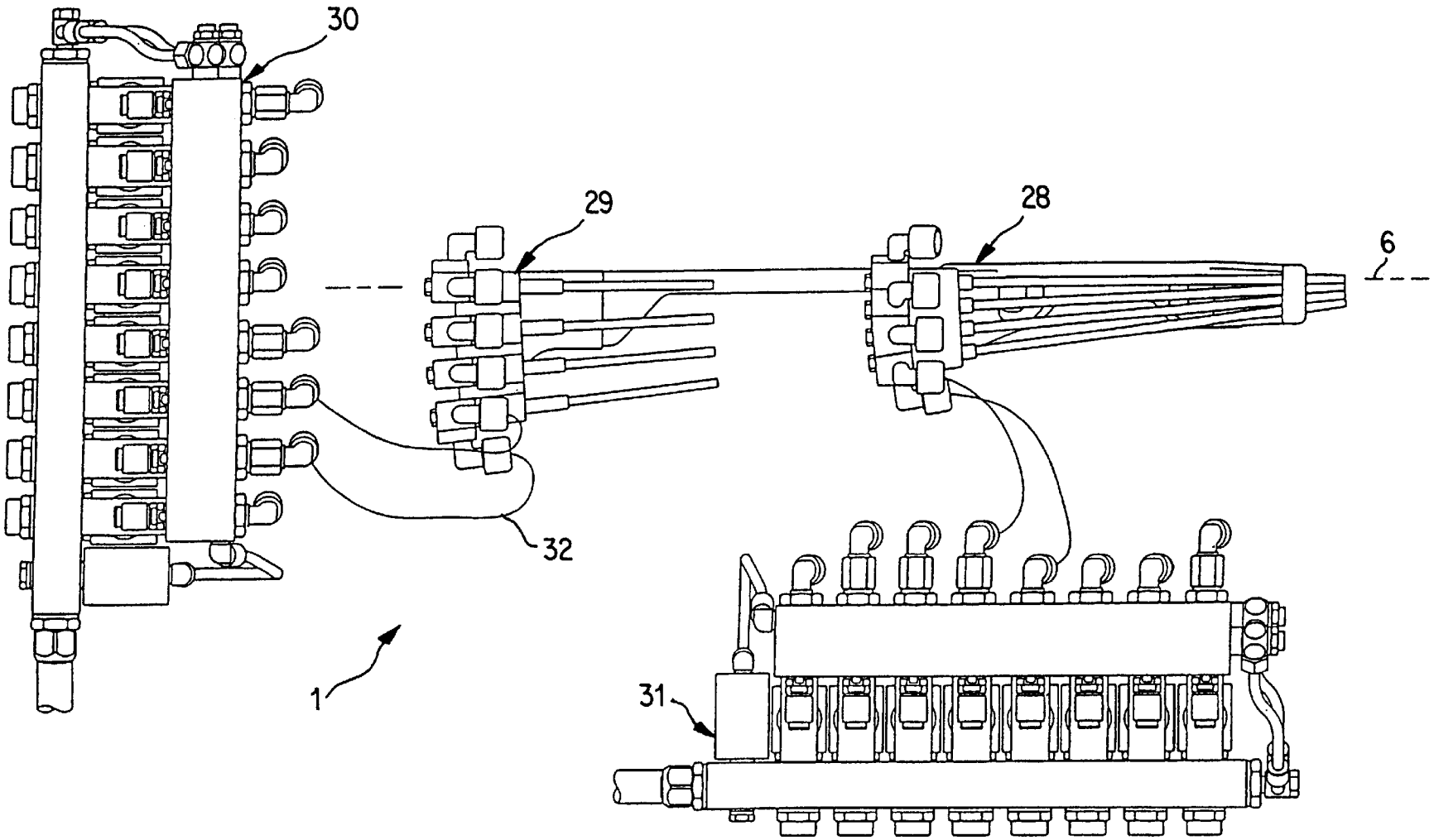
FIG. 4 is a top view of an embodiment with the distributor blocks staggered in space.

If a so-called tandem nozzle arrangement like that in FIG. 4 is used, consisting of pre-nozzle 29 and a main nozzle 28, it is advantageous to stagger the individual distributor blocks 30, 31 in space in the direction of lengthwise axis 6 of sley 5. The distributor block 30 serves to supply pre-nozzle 29 while distributor block 31 serves to supply main nozzle 28. Thus, the length of the individual pressure lines 32 can be kept short. Provision can also be made to locate an additional distributor block opposite distributor block 31 immediately adjacent to nozzles 28, 29 coming in such fashion as shown in FIG. 1.

Figure 2:
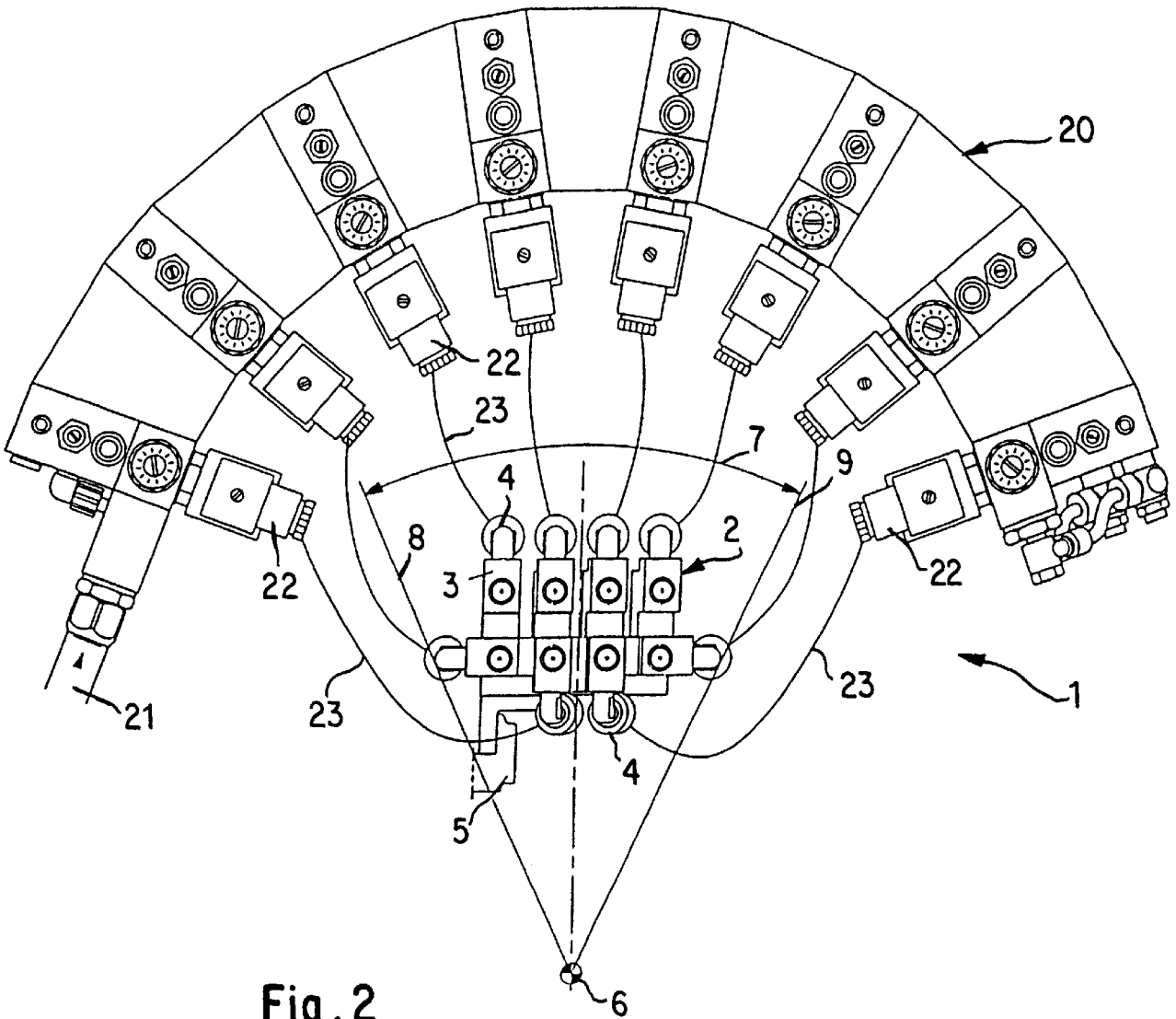
FIG. 2 is a front view of a weft thread insertion device constructed according to a second embodiment of the invention.

FIG. 2 shows another embodiment of the weft thread insertion device. In this case, only one distributor block 20 is used, arranged in the shape of arc around the main nozzle block 2. Distributor block 20 has a main air supply 21. Distributor block 20 distributes the supplied compressed air to a plurality of outlets 22, which are preferably arranged at regular intervals apart on the arc formed by distributor block 20. Thus, there is at least one outlet 22 of distributor block 20 for each inlet 4 on the individual nozzles 3 of main nozzle block 2, said outlet being closest to this inlet 4 in one of the two end positions 8, 9 of sley 5. Preferably, it is precisely this outlet 22 that is connected by a flexible pressure line 23 with the corresponding inlet 4 of individual nozzle 3. As a result, the length of the pressure lines 23 can be kept very short, with the determination of the length once again being governed by the end positions 8, 9 of sley 5 located remotely from the selected outlet 22.

Figure 3:
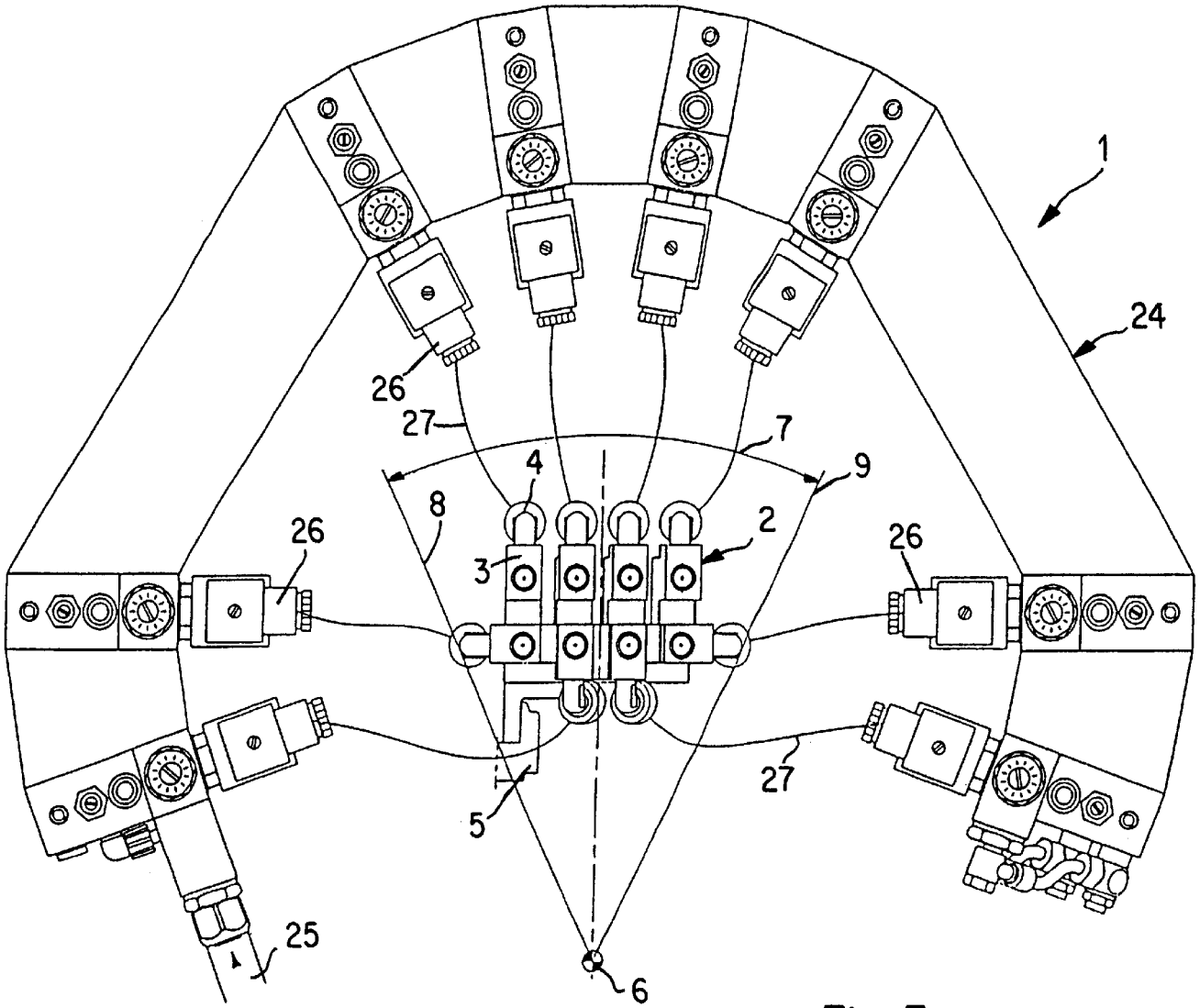
FIG. 3 is a front view of a weft thread insertion device constructed according to a third embodiment of the invention.

Finally, FIG. 3 shows another design of the weft thread insertion device. A single distributor block 24 is provided, supplied by a main air supply 25 and consisting of a plurality of individual elements connected with one another. As a result, an approximately arcuate design of distributor block 24 is obtained. The outlets 26 to supply air to main nozzle block 2 can be distributed freely and in a suitable fashion on the individual elements. In the example, 4 outlets 26 are provided in the upper area of distributor block 24 and 2 outlets 26 are provided in each of the two side areas. To supply air to the main nozzle block 2, in the manner described above, the closest outlets 26 of distributor block 24 are associated as closely as possible with the inlets 4 of the individual nozzles 3 and connected by a pressure line 27, with the length of pressure lines 27 being determined as in the examples according to FIG. 1 and FIG. 2.

The drawing reference numbers and the structures referred to are listed below to aid in understanding the preferred embodiment of the invention.

1 weft thread insertion device
2 main nozzle block
3 individual nozzle
4 inlet
5 reed
6 axis
7 direction of motion
8 end position
9 end position
10 distributor block
11 main air supply
12 outlet
13 distributor block
14 main air supply
15 outlet
16 distributor block
17 main air supply
18 outlet
19 pressure line
20 distributor block
21 main air supply
22 outlet
23 pressure line
24 distributor block
25 main air supply
26 outlet
27 pressure line
28 main nozzle
29 pre-nozzle
30 distributor block
31 distributor block
32 pressure line The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Weft thread insertion assembly for an air jet loom, comprising:

a main nozzle block mountable on a loom slew to be movable together with the sley, a plurality of main nozzles supported on the main nozzle block, one stationary distributor block, said distributor block including a plurality of distributor block outlets, and flexible pressure lines connecting respective ones of the distributor block outlets with respective ones of the main nozzles, wherein the one stationary distributor block is disposed so as to at least partially surround the main nozzle block in all operating positions of the main nozzle block, and wherein said distributor block outlets are located spaced from one another in an arc shaped pattern surrounding said main nozzle block.

2. Weft thread insertion assembly according to claim 1, wherein said arc shaped pattern is U-shaped.

3. Weft thread insertion assembly according to claim 2, wherein a total of eight distributor block outlets are provided which are disposed to face a respective plurality of sides of the main nozzle block.

4. Weft thread insertion assembly for an air jet loom, comprising:

a main nozzle block mountable on a loom sley to be movable together with the sley, a plurality of main nozzles supported on the main nozzle block, a plurality of stationary distributor blocks, said distributor blocks including a plurality of distributor block outlets, and flexible pressure lines connecting respective ones of the distributor block outlets with respective ones of the main nozzles, wherein the distributor blocks are disposed so as to at least partially surround the main nozzle block in all operating positions of the main nozzle block, and wherein the stationary blocks each contain a plurality of distributor block outlets which face respective different sides of the main nozzle block.

5. Weft thread insertion assembly according to claim 4, wherein said distributor block outlets are located spaced from one another in an arc shaped pattern surrounding said main nozzle block.

6. Weft thread insertion assembly according to claim 5, wherein said arc shaped pattern is U-shaped.

7. Weft thread insertion assembly according to claim 6, wherein a total of eight distributor block outlets are provided which are disposed to face a respective plurality of sides of the main nozzle block.

8. Weft thread insertion device for an air jet loom comprising at least one main nozzle block adapted to be mountable on a sley and movable together with the latter, said main nozzle block having at least one individual nozzle, devices for supplying compressed air to the main nozzle block with which a plurality of individual stationary distributor blocks are associated, said distributor blocks each having at least one outlet, from which outlet compressed air is supplied through a flexible pressure line to the inlet of a respective individual nozzle of the main nozzle block, wherein the stationary distributor blocks at least partially surround the main nozzle block independently of the position of the sley and are arranged approximately in the shape of an L or a U around the main nozzle block.

9. Weft thread insertion device according to claim 8, wherein the individual distributor blocks are adapted to be located in a plane perpendicular to a lengthwise axis of the sley.

10. Weft thread insertion device according to claim 8, wherein the individual distributor blocks are adapted to be arranged staggered with respect to one another in space in a direction of the lengthwise axis of the sley.

11. Weft thread insertion device according to claim 8, wherein each outlet of the stationary distributor blocks is connected with a controllable valve.

12. Weft thread insertion device according to claim 11, wherein the inlets for individual nozzles on the main nozzle block are distributed on a circumference of the main nozzle block.

13. Weft thread insertion device according to claim 9, wherein each outlet of the stationary distributor block is connected with a controllable valve.

14. Weft thread insertion device according to claim 13, wherein the inlets for individual nozzles on the main nozzle block are distributed on a circumference of the main nozzle block.

15. Weft thread insertion device according to claim 10, wherein each outlet of the stationary distributor block is connected with a controllable valve.

16. Weft thread insertion device according to claim 15, wherein the inlets for individual nozzles on the main nozzle block are distributed on a circumference of the main nozzle block.

17. Weft thread insertion device according to claim 8, wherein the inlets for individual nozzles on the main nozzle block are distributed on a circumference of the main nozzle block.

18. Weft thread insertion device for an air jet loom comprising at least on e main nozzle block adaptable to be mountable on a sley and movable together with the latter, said main nozzle block having at least one individual nozzle, devices for supplying compressed air to the main nozzle block with which a stationary distributor block is associated, said distributor block having a plurality of outlets, from which outlets compressed air is supplied through respective flexible pressure lines to the inlet of a respective individual nozzle of the main nozzle block, wherein the stationary distributor block at least partially surrounds the main nozzle block independently of the position of the sley, said distributor block being in the shape of an arc or U, on which the distributor block the plural outlets are spaced from one another at regular or variable intervals.

19. Weft thread insertion device according to claim 18, wherein the distributor block comprises a plurality of individual elements connected with one another and the outlets are distributed freely on the individual elements.

20. Weft thread insertion device according to claim 18, wherein each outlet of the stationary distributor block is connected with a controllable valve.

21. Weft thread insertion device according to claim 20, wherein the inlets for individual nozzles on the main nozzle block are distributed on a circumference of the main nozzle block.

22. Weft thread insertion device according to claim 19, wherein each outlet of the stationary distributor block is connected with a controllable valve.

23. Weft thread insertion device according to claim 19, wherein the inlets for individual nozzles on the main nozzle block are distributed on a circumference of the main nozzle block.

24. Weft thread insertion device according to claim 22, wherein the inlets for individual nozzles on the main nozzle block are distributed on a circumference of the main nozzle block.

25. Weft thread insertion device according to claim 18, wherein the inlets for individual nozzles on the main nozzle block are distributed on a circumference of the main nozzle block.

* * * * *